US007248791B2

(12) United States Patent
Toth

(10) Patent No.: US 7,248,791 B2
(45) Date of Patent: Jul. 24, 2007

(54) HEATER CONTROL

(76) Inventor: Peter R. Toth, 7911-118A Street, Edmonton, Alberta (CA) T6G 1V4

( * ) Notice: Subject to any disclaimer, the term of this patent is extended or adjusted under 35 U.S.C. 154(b) by 425 days.

(21) Appl. No.: 10/727,487

(22) Filed: Dec. 5, 2003

(65) Prior Publication Data

US 2005/0121461 A1 Jun. 9, 2005

(51) Int. Cl.
*F24H 1/18* (2006.01)

(52) U.S. Cl. ..... 392/459; 392/441; 222/3

(58) Field of Classification Search ..... 392/459
See application file for complete search history.

(56) References Cited

U.S. PATENT DOCUMENTS 2,801,320 A * 7/1957 Prindle ..... 219/528
3,852,566 A * 12/1974 Quirk et al. ..... 392/454
4,255,646 A 3/1981 Dragoy et al.
4,645,904 A 2/1987 Moraski et al.
4,833,299 A * 5/1989 Estes ..... 392/444
5,168,546 A * 12/1992 Laperriere et al. ..... 392/454
5,673,736 A 10/1997 Farkas
5,827,050 A * 10/1998 Price ..... 417/207
5,999,700 A * 12/1999 Geers ..... 392/441
6,380,523 B1 * 4/2002 Jones, Sr. ..... 219/528
6,898,374 B1 * 5/2005 Wen ..... 392/459
7,015,425 B2 * 3/2006 Neal et al. ..... 219/386

* cited by examiner

*Primary Examiner*—Thor Campbell

(57) ABSTRACT

A tank heater control that will control a heater used for heating pressurised tanks over a broad range of temperatures. The system uses a sensor for providing a signal to a processor, in which the signal is indicative of flow of gas from the tank. The processor energizes the heater when gas flows from the tank. In various embodiments, the sensor may be a flow sensor on an outlet from the tank, temperature sensors that detect a difference in temperature of the tank from ambient temperature, or a pressure sensor on an outlet from the tank.

8 Claims, 2 Drawing Sheets

HEATER CONTROL

BACKGROUND OF THE INVENTION

This invention relates to control devices used in conjunction with heating pads when heating barrels and tanks, particularly those that are pressurised and which may contain hazardous materials.

In industry and life in general there is frequently found the necessity for heating the contents of a tank that is located in a place subject to the ravages of the outdoors and the associated elements. A practical method to warm the contents is by utilising an electric heater strapped to the tank. There are a number of such systems available, some of which are controlled by temperature sensing elements and some of which have no controls and they do heat tanks as required.

These systems in general include a heating element, a means by which to attach it to the tank and a power supply cable. In certain applications it is imperative that a limited amount of heat be applied to the tank so as to prevent overheating or over-pressurisation of the contents of the tank. To ensure that the tank contents do not go above a pre-determined safe set-point some systems limit the amount of power of the heater while other systems utilise a fixed point, temperature limiting thermostat as a safety cut-out while other systems use a combination of the two. There follows a list of problems associated with these types of systems when utilised for heating liquid pressurised gas (LPG) in tanks or cylinders.

LPG is used as a fuel over a broad range of temperatures in many areas of the world ranging from the arctic to the tropics. The mix of LPG is particular to each region and depends on the local requirements and each mix has its own heating requirements.

LPG is stored in pressurised tanks in the form of liquid and gas. The liquid portion being heavier fills the lower portion of the tank cavity and the gas being lighter fills the upper portion of the tank cavity. When the need arises, gas is withdrawn from the upper region of the tank and obeys the laws of chemical thermodynamics. As the gas is withdrawn the LPG temperature drops and the pressure within the tank drops thus making it difficult to obtain sufficient quantities of gas from the tank. By applying heat to the liquid contents of the tank the pressure within the tank is increased and greater quantities of gas may be withdrawn from the tank. If too much heat is applied to the tank the pressure could increase to the point where a safety release valve would be activated, releasing explosive gas into the atmosphere thus creating a dangerous situation. It is therefore desirable to heat the tank in a controlled fashion.

In the case of a heater that relies on a thermostat for safety there are three possible common configurations for the thermostat. In the first configuration the thermostat senses and limits the temperature of the heater. In the second configuration the thermostat senses and limits the temperature of the tank. In the third configuration the thermostat senses the ambient air temperature and in combination with a lower power of heater, ensures that the tank contents will not over-heat or become over-pressurised. In the case of the heater that has no thermostat the heating capacity is reduced so as not to overheat or over-pressurise the tank.

The problem with the systems that utilise the thermostats is that they are limited to pre-set operating temperatures which are not functional over a broad range of ambient temperatures. The problem with the systems that have no thermostats is that they have lower heating capacities and thus do not provide sufficient heating capacities in the warmer climates.

SUMMARY OF THE INVENTION

To address these problems, there is therefore provided according to an aspect of the invention a tank heater control that will control a heater used for heating pressurised tanks over a broad range of temperatures. The system uses a sensor for providing a signal to a processor, in which the signal is indicative of flow of gas from the tank. The processor energizes the heater with power from an adequate power source when gas flows from the tank. In various embodiments, the sensor may be a flow sensor on an outlet from the tank, temperature sensors that detect a difference in temperature of the tank from ambient temperature, or a pressure sensor on an outlet from the tank.

Further features and advantages of the invention will appear from the description that follows.

BRIEF DESCRIPTION OF THE FIGURES

There will now be described preferred embodiments of the invention, with reference to the drawings, by way of illustration, in which like numerals denote like elements and in which.

DESCRIPTION OF THE PREFERRED EMBODIMENT

In this patent document, the word "comprising" is used in its inclusive sense and does not exclude other elements being present. The indefinite article "a" before an element of a claim does not preclude other instances of the element being present. "Tank" as used in this patent document includes any cylinder or tank used for the storage of gas.

Figure 1:
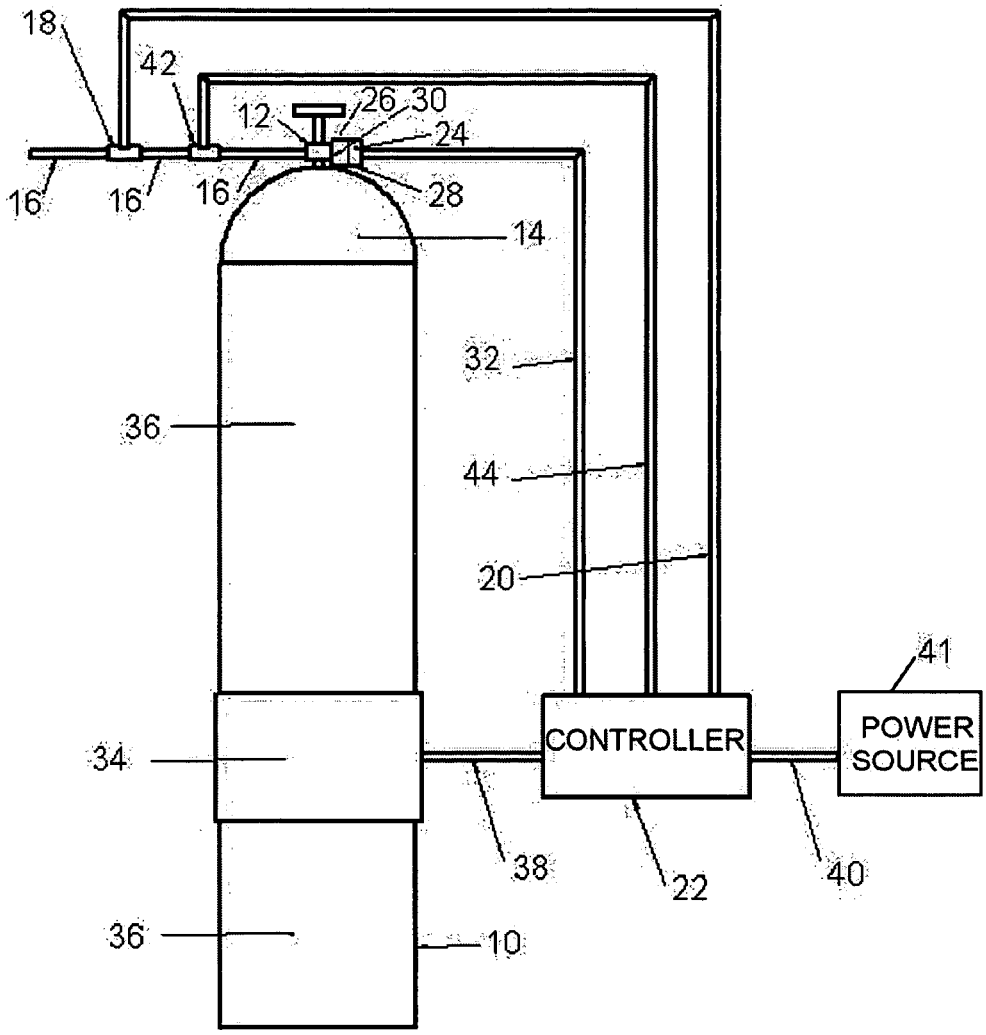
FIG. 1 shows a schematic of a heater attached to a tank with both flow, pressure and temperature sensors on a tank and a processor.

Referring to FIG. 1, a propane tank 10 has a shut-off valve 12, which controls the flow of gas 14 through hose 16. A flow sensor 18 in line with hose 16 senses when gas 14 is being withdrawn from tank 10 by detecting the flow of gas within the hose 16. A pressure sensor 42 in line with hose 16 senses when the pressure drops in tank 10. Temperature sensor 24 detects the ambient air temperature at surface 28 and temperature sensor 26 detects the temperature of the tank 10 at the valve 12 on surface 30. The flow, pressure and temperature signals are transmitted through cables 20, 44 and 32 respectively to processor 22. Conventional sensors of any suitable design may be used for the sensors 18, 24, 26 and 42. The processor 22 controls heater 34, which is commercially available from High-Q Design of Edmonton, Alberta and determines when heater 34 is energised thereby heating the liquid 36 inside the tank 10. Heater 34 should be attached to the tank 10 in a secure manner, such as by using straps around the tank. Cable 38 transmits power from the processor 22 to the heater 34. Power is supplied to the processor 22 through cable 40, which obtains power from power source 41. Power source 41 must have sufficient power to energize the heater sufficiently for practical use, and will usually be an AC power source. In North America, the power source will typically be the 120 VAC power source available from the main electrical public utilities or equivalent private power sources. The heaters 34 is preferably a portable heater as defined in the Canadian Electrical Code or such other equivalent code in the country of use. Such heaters are removable and designed for easy change out when a cylinder needs changing or if the heater 34 burns out. In the case of tanks, the heaters 34 can stay on during a fill but may be removed when the tanks are moved to other locations. The heater 34 must have sufficient power or heating capacity to replace the amount of LPG that is being withdrawn from the tank. The power source 41 then must have sufficient capacity to supply the heater 34. Given the vaporization rates which lead to needing a heater, 12 volt battery systems are not practical for the power requirements.

A first control mechanism according to the invention uses the two temperature detecting devices 24, 26. One sensor detects the ambient air temperature while the second detects the temperature of the tank next to the gas. Before gas is withdrawn the temperature of the tank 10 is equal to the ambient air temperature. As gas is withdrawn from the tank 10 the temperature of the LPG drops and consequently the temperature of the tank 10 drops. In particular, the tank surface 30 adjacent to the gas drops significantly and the thinner metal fittings attached to the top of the tank 10 are the most sensitive to this change in temperature. By measuring the difference between the ambient and the tank temperature it can be determined when gas is being withdrawn from the tank 10.

Figure 2:
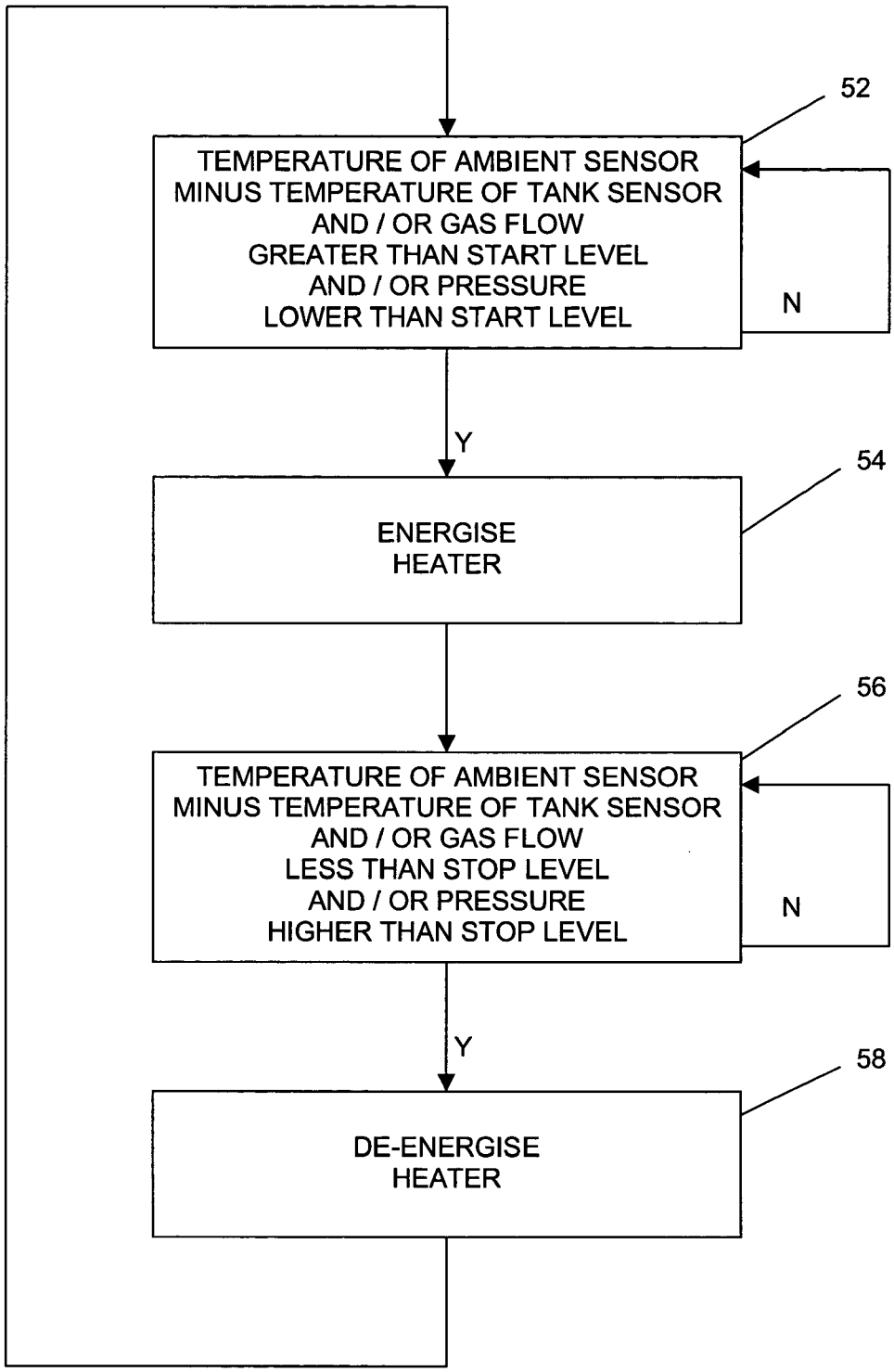
FIG. 2 shows a flow diagram for the control of the heater.

A variety of electronic circuits or electromechanical devices acting as processor 22 can be used to detect the difference in the two temperatures and control when the heater 34 is energised. FIG. 2 show the basic steps carried out by the processor 22. In step 52, the processor 22 tests whether there is a signal indicative of flow of gas from the tank 10, and in step 54 energizes the heater if there is such a signal. In step 56, the processor 22 tests whether flow has stopped, and if it has, the heater 34 is de-energized in step 58. Once the heater 34 is de-energized, the processor 22 re-commences testing whether flow has started. In the case of using two temperature detecting devices 24, 26 as the sensor, the parameter used by the processor 22 is the difference in the temperatures measured by the two devices 24, 26. When a first pre-set value of the difference in sensed temperatures is reached the heater 34 is energised, and when the difference in the two sensed temperatures is reduced to a second pre-set value the heater is de-energised thus preventing over-pressurisation of the tank 10.

A second control mechanism uses the flow sensor 18 inserted in line with the hose 16 though which the gas flows out of the tank 10. The same processor 22 may be used for control of the heater 34. As indicated in the FIG. 2, when a first pre-set flow rate is sensed (step 52), the heater 34 is energised (step 54), when the flow is sensed as being reduced to a second pre-set value (step 56), the heater 34 is de-energised (step 58) thus preventing over-pressurisation of the tank.

A third control mechanism uses pressure sensor 42 inserted in line with the hose 16 through which the gas flows out of the tank 10. Processor 22 also may be used to process the signal from pressure sensor 42 to detect the drop in pressure of gas and control when the heater is energised. As shown in FIG. 2, when the pressure is sensed as having dropped to a first pre-set pressure (step 52), the heater 34 is energised (step 54), and when the pressure is sensed as having risen to a second pre-set value (step 56), the heater 34 is de-energised (step 58) thus preventing over-pressurisation of the tank.

The three control mechanisms operate independently of ambient air temperature and thus can be used in any location regardless of local conditions. One or more of the control mechanisms may be used, although in practice only one of the control mechanisms will usually be required. The electromechanical or electronic controls of the processor 22 can be located at the sensing point or mounted remotely or be an integral part of the heater. The processor 22 may be a simple electric circuit made of hardware parts, or may be part of a programmed microprocessor, using hardware, firmware or software.

Some advantages of the present invention are that the control is independent of the ambient temperature and simply depends on gas being withdrawn form the tank 10. The processor 22 or whatever control mechanism is utilised can be mounted on the tank 10, incorporated as part of the heater or can be located away from both in a remote location. The tank system disclosed here has particular utility at remote oil industry sites, such as well sites.

A person skilled in the art could make immaterial modifications to the invention described and claimed in this patent disclosure without departing from the essence of the invention.

What is claimed is:

1. A tank system comprising:

a tank containing gas;

a heater attached to the tank for heating the tank, the heater having sufficient heating capacity to maintain pressure in the tank when gas is withdrawn from the tank;

a power source with sufficient power to operate the heater;

a sensor for providing a signal indicative of flow of gas from the tank, in which the sensor detects a difference in temperature of the tank from ambient temperature as indicative that flow of gas from the tank is occurring; and a processor responsive to the sensor signal and communicating with the heater, the processor being configured to energize the heater with power from the power source when gas flows from the tank.

2. The tank system of claim 1 in which the tank contains liquid petroleum gas.

3. The tank system of claim 1 in which the tank contains propane.

4. The tank system of claim 1 in which the tank system is installed at a remote oil industry site.

5. The tank system of claim 2 in which the tank is a cylinder.

6. The tank system of claim 5 in which the heater is portable.

7. The tank system of claim 6 in which the heater is strapped to the cylinder.

8. A tank system comprising:

a cylinder containing liquid petroleum gas;

the cylinder having an outlet valve, a hose being attached to the outlet valve;

a heater attached to the cylinder for heating the cylinder, the heater having sufficient heating capacity to maintain pressure in the cylinder when the gas is withdrawn from the cylinder;

a power source with sufficient power to operate the heater;

a flow sensor inline with the hose for providing a signal indicative of flow of gas from the cylinder; and a processor responsive to the flow sensor signal and communicating with the heater, the processor being configured to energize the heater with power from the power source when gas flows from the cylinder as indicated by the flow sensor.

* * * * *